United States Patent [19]

Gasser

[11] Patent Number: 4,949,431

[45] Date of Patent: Aug. 21, 1990

[54] APPARATUS FOR COMPRESSING AND AUTOMATICALLY INTRODUCING A TEXTILE FIBER SLIVER

[75] Inventor: Hermann Gasser, Frauenfeld, Switzerland

[73] Assignee: Hollingsworth GmbH, Neubulach, Fed. Rep. of Germany

[21] Appl. No.: 320,339

[22] Filed: Mar. 8, 1989

[30] Foreign Application Priority Data

Mar. 8, 1988 [DE] Fed. Rep. of Germany ..... 3807582

[51] Int. Cl.[5] ..... D01G 25/00

[52] U.S. Cl. ..... 19/150

[58] Field of Search ..... 19/150, 157, 152, 281

[56] References Cited

U.S. PATENT DOCUMENTS 4,829,758 5/1989 Gilhaus ..... 57/22

FOREIGN PATENT DOCUMENTS 934875 11/1955 Fed. Rep. of Germany ..... 19/157
531578 1/1973 Switzerland ..... 19/150
524887 8/1940 United Kingdom ..... 19/150
593310 10/1947 United Kingdom ..... 19/157

*Primary Examiner*—Werner H. Schroeder
*Assistant Examiner*—D. Price
*Attorney, Agent, or Firm*—Townsend and Townsend

[57] ABSTRACT

Known apparatuses comprise a feed passage (4), a nozzle passage (5) extending therefrom in the feed direction (T), and a flow generator for generating a feed gas flow in the feed passage. The outlet portion of the nozzle passage (5) has provided therein a lateral opening (13) which permits the outflow of the gas stream.

To be able to carry out pressure measurements in a measuring funnel with a known apparatus as well, the apparatus comprises a control (40) through which the lateral openings (13) can be closed. After the opening has been closed, pressure which can be measured with the aid of a pressure sensor (42) builds up in the tapered nozzle passage. The pressure measured corresponds to the thickness of the fiber sliver and can be used for controlling an upstream card.

The apparatus is employed during the feed of card slivers.

13 Claims, 4 Drawing Sheets

APPARATUS FOR COMPRESSING AND AUTOMATICALLY INTRODUCING A TEXTILE FIBER SLIVER

DESCRIPTION

This invention relates to an apparatus for compressing and automatically introducing a textile fiber silver into a feed nip, in particular a roller nip, comprising a feed passage, a flow generator for generating a gas flow in the feed passage, and an insertion nozzle extending from the feed passage and including a nozzle passage aligned with the feed passage and tapered in the flow direction, as well as at least one lateral opening in the outlet portion for permitting the gas flow to escape from the nozzle passage.

U.S. Pat. No. 4,318,206 discloses an apparatus of this type wherein the nozzle has provided therein a series of openings through which the feed gas can escape.

Such an apparatus is also disclosed in EP-OS 0 261 330. In the arrangement shown therein the opening in the outlet portion is formed as a longitudinal slot extending from the outlet port of the nozzle passage in the longitudinal direction thereof in a plane substantially perpendicular to the plane of the feed nip, the contour of the insertion nozzle provided at the outlet side being adapted at both sides of the guide slot to the contour of the structural member, in particular rollers, defining the feed nip.

With respect to the control of known cards and the achievement of a uniformly thick fiber sliver, the latter is guided through a measuring funnel in which a pressure corresponding to the thickness of the fiber sliver builds up. This pressure is measured and serves to control the rotational speed of the feed roller of the card. The known measuring funnels have a very small outlet cross-section; that is why the fiber sliver must be manually introduced therein. If one does not wish to dispense with the known control of the fiber sliver thickness, which has proved quite successful in practice, the fiber sliver must be manually drawn in—at least at this point. The advantages of the automatic introduction apparatus, however, are virtually nullified thereby.

It is therefore the object of the present invention to provide an apparatus of the above-mentioned type which permits the automatic introduction of a textile fiber sliver and the use as a measuring funnel for detecting the thickness of the fiber sliver.

According to the invention this object is attained by constructing the lateral opening in such a way that it is adapted to be closed by means of a control, said control keeping the lateral opening open during the introduction of the fiber sliver and closing same during the subsequent feed.

As a result of this measure, the feed gas can escape through the lateral opening during the introduction phase, whereby the fiber sliver can be drawn in automatically without any accumulation of pressure impeding the introduction of the fiber sliver. As soon as the fiber sliver is gripped by the feed nip and advanced, the lateral opening is closed by means of the control so that pressure can now build up in the tapered nozzle passage by reason of the air entrained by the fiber sliver. This pressure which varies in response to the thickness of the fiber sliver can be measured and used for controlling an upstream card.

In this connection it is of advantage to provide a pressure sensor in the outlet portion of the nozzle passage. At this place the pressure build-up is most uniform and correlates best with the thickness of the fiber sliver.

It is also advantageous to form the lateral opening as a longitudinal slot extending from the outlet port of the nozzle passage in the longitudinal direction thereof in a plane substantially perpendicular to the plane of the feed nip. During the introduction phase the fiber sliver can thus radially expand, which considerably facilitates the introduction of the fiber sliver. In the subsequent feed phase, when the longitudinal slot is closed, the fiber sliver is compressed in the outlet port to an even greater extent, which is beneficial to a uniform pressure build-up in the nozzle passage.

In a plane in which the longitudinal axis of the feed passage is substantially located, the insertion nozzle is divided—according to a preferred embodiment—into two halves which for forming longitudinal slots are constructed such that they can be moved apart and fixed at least in the nozzle portion, the longitudinal slots being adapted to be closed by bringing the halves into contact with each other. A double function is obtained with this construction of the insertion nozzle.

During the insertion phase in which the fiber sliver is drawn in with the aid of the apparatus, this moving apart of the two nozzle halves does not only result in the formation of the longitudinal slots, which are necessary for the escape of the feed gas, but also in a simultaneous expansion of the cross section of the nozzle passage so that the introduction of the fiber sliver is considerably simplified. This effect can be made use of in such a way that when the two nozzle halves are in contact with each other, the nozzle passage has a cross section which is much smaller—at least in the outlet portion—than that in known automatic introduction apparatuses. During the feed operation the compression of the fiber sliver is improved by this measure, which results, on the one hand, in an improved subsequent feed and, on the other hand, in a more uniform pressure build-up in the nozzle passage.

With the help of a simple construction, the nozzle halves can be moved apart and brought into contact with each other by pivotally supporting the nozzle halves at their ends facing the feed passage. At the same time, an overproportional increase in the cross section, in particular, of the outlet port of the nozzle passage is accomplished in the introduction phase of the fiber sliver. Since in the closed state of the two nozzle halves the nozzle passage has a conical shape, an almost uniform flow cross-section can be achieved in the nozzle passage during the introduction phase.

To bring the two nozzle halves into contact with each other during the feed operation, an especially simple construction provides that the nozzle halves should be adpated to be pressed against each other by resilient elastic elements substantially radially acting thereon in the outlet portion so as to close the longitudinal slots. To open the two nozzle halves, same must merely be moved in the feed phase of the fiber sliver against the action of the resilient elastic elements.

A simple support of the two nozzle halves is obtained when same comprise at their respective end facing the feed passage a projection which radially protrudes outwards and is supported on an outer abutment and about which the respective nozzle half is pivotable against the action of the resilient elastic elements. In this case the resilient elastic members may preferably be supported on the outer abutment as well. When pressure acting in the direction of feed is exerted on the ends of the two nozzle halves facing the feed passage, the two nozzle halves respectively pivot about the projection supported on the outer abutment and open in a beaklike way.

By virtue of the axial pressure which acts on the ends of the two nozzle halves facing the feed passage and which is meant to open said halves in the introduction phase, the feed passage can preferably be formed as a tubular body which is displacable in a housing in the longitudinal direction thereof relative to the nozzle.

The tubular body can be moved in the direction of the nozzle in a simple way by providing the tubular body on the outside thereof with an annular piston which is displacably arranged together with the tubular body in an annular cylinder chamber of the housing. As a result thereof, the tubular body can be axially moved in the housing like a piston/cylinder arrangement towards the end of the two nozzle halves to effect the opening thereof.

It is of advantage when the cylinder chamber is adapted to be connected to a compressed air source through air ducts. This compressed air source may be identical with the one that also generates the feed gas flow in the feed passage during the introduction phase of the feed sliver. This is advantageous for the reason that the feed gas flow, too, must only be maintained during the introduction phase of the fiber sliver and can be cut off during the feed phase.

When the nozzle halves are in contact with each other, a rectangular cross-section of the outlet port of the nozzle passage is preferred. The lateral lengths of the rectangle are preferably chosen such that the outlet port has a substantially square configuration in the open state of the two nozzle halves. This has the advantage that during the transition from the introduction phase to the feed phase, i.e. during closing of the two nozzle halves, pressure is applied to the fiber sliver only in the closing direction of the two nozzle halves; clamping of edge fibers between the nozzle halves during closing thereby prevented in a simple way.

The present invention also relates to an apparatus for compressing and automatically introducing a textile fiber sliver into a feed nip, in particular a roller nip, comprising a feed passage, a flow generator for generating a gas flow in the feed passage, and an insertion nozzle extending from the feed passage and including a nozzle passage aligned with the feed passage and tapered in the flow direction.

For such an apparatus the object of the invention is attained by providing a pressure sensor in the outlet portion of the nozzle passage.

It is also possible to select the cross section of the outlet portion of automatic introduction apparatuses such that, on the one hand, the pressure build-up in the nozzle passage is so small that the fiber sliver can be introduced automatically and that, on the other hand, the pressure build-up is sufficient enough to draw conclusions from the pressure measurement in the area of the outlet port to the thickness of the fiber sliver.

An embodiment of the invention will now be explained in detail with reference to a drawing wherein.

FIGS. 1 to 4 show an apparatus for compressing and automatically introducing a textile fiber sliver into a feed nip 1. In the embodiment which is here shown, the feed nip 1 is formed by a pair of feed rollers 2 driven in a direction opposite to the arrow direction. When viewed in the feed direction T, the apparatus is located in front of the pair of feed rollers 2.

Figure 1:
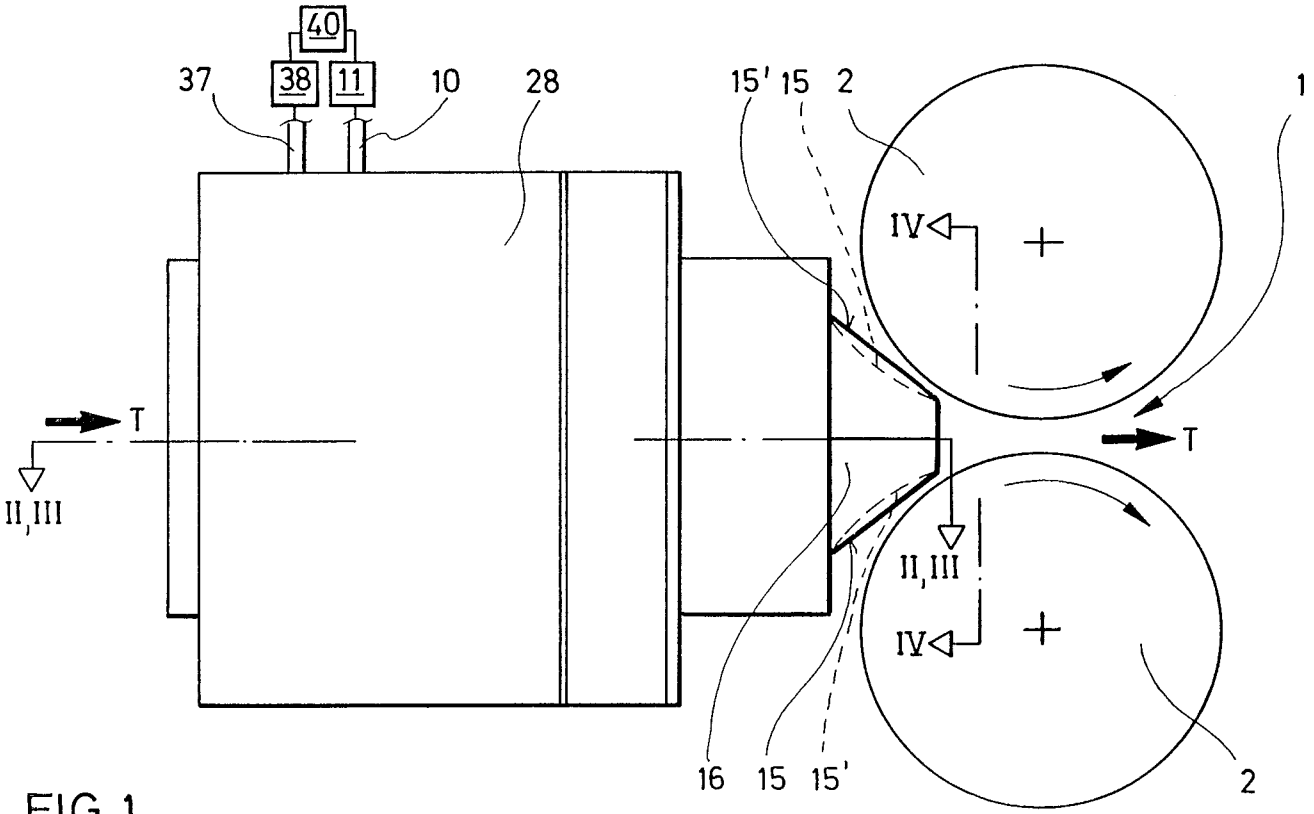
FIG. 1 is a sideview of the apparatus of the invention in front of a pair of feed rollers.
Figure 2:
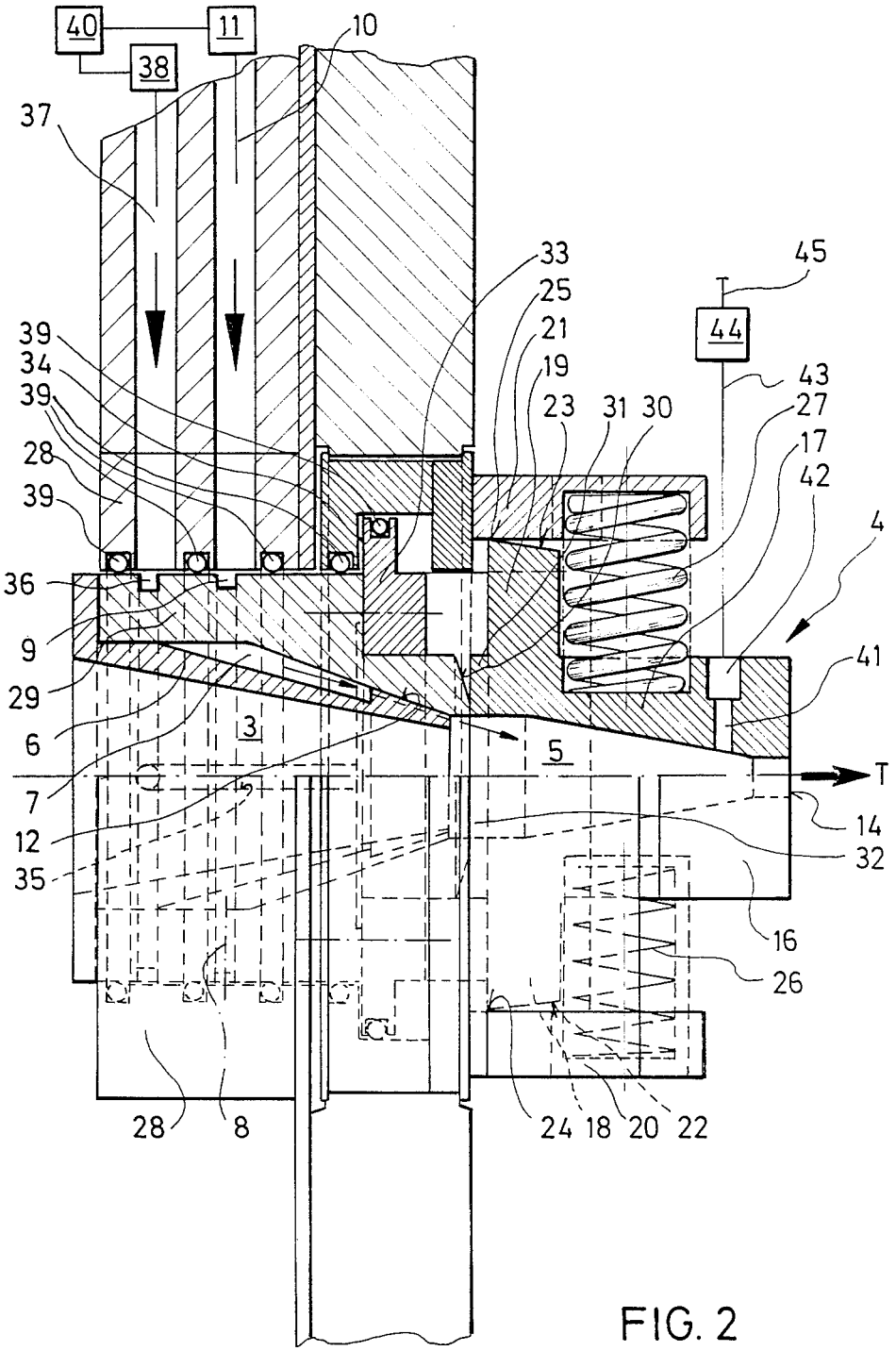
FIG. 2 is a partial top view of the apparatus of FIG. 1 cut along line II—II.

As can more clearly be seen from FIG. 2, the apparatus comprises a feed passage 3 conically tapered in the feed direction T and an insertion nozzle 4 adjacent thereto in the feed direction T. A nozzle passage 5 which is also tapered in the feed direction T is adjacent to and in alignment with the feed passage 3 in the insertion nozzle 4.

The feed passage 3 has disposed therein a conically converging sleeve 6 which defines with its outer circumference a gas chamber 7 which, on the one hand, is connected to a flow generator, such as a compressed air source 11, through a radial bore 8, an annular groove 9 and a compressed air pipe 10 and, on the other hand, to the insertion end of the nozzle passage 5 through spiral grooves 12. A gas flow is thereby generated in the nozzle passage and in the feed passage in the feed direction T.

Figure 3:
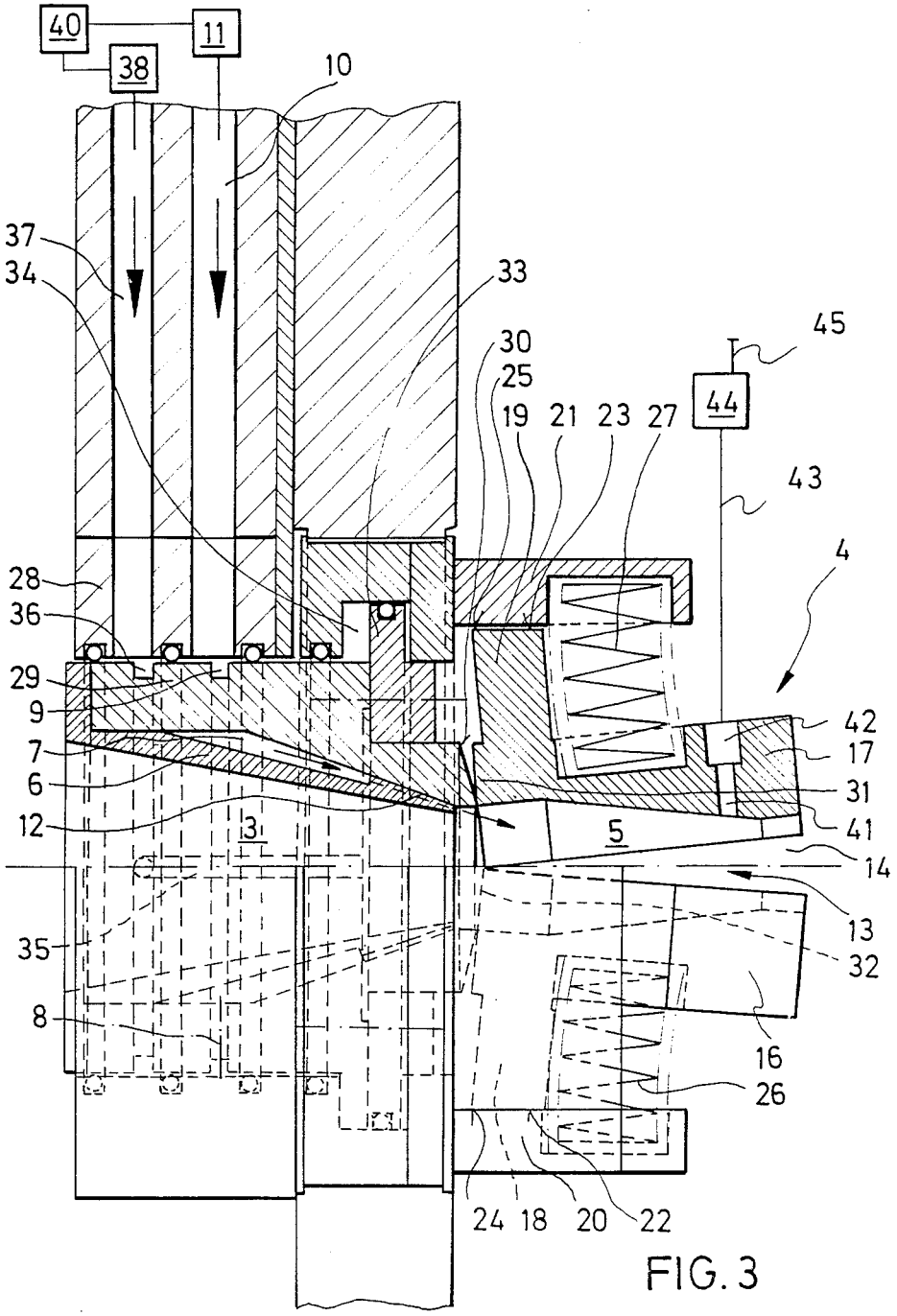
FIG. 3 is the same view of the apparatus as in FIG. 2, however with opened nozzle halves.

As can more clearly be seen from FIG. 3, the insertion nozzle 4 comprises, in the outlet portion, lateral openings 13 which permit the gas flow to escape from the nozzle passage 5. The lateral openings 13 extend as longitudinal slots from the outlet port 14 of the nozzle passage 5 in the longitudinal direction thereof against the feed direction T in a plane substantially perpendicular to the plane of the feed nip 1.

The outer contour 15 of the insertion nozzle 4 is closely adapted to the outer contour of the pair of feed rollers 2; as is shown by the broken line, the outer contour 15′ may here have the same radius of curvature as the rollers of the pair of feed rollers 2.

In the embodiment which is here shown, the longitudinal slots in the insertion nozzle 4 are formed by dividing the insertion nozzle 4 into two nozzle halves 16 and 17 in a plane E—E in which the longitudinal axis of the feed passage 3 is substantially located and which is perpendicular to the plane of the feed nip 1. At their ends facing the feed passage 3 the two nozzle halves have radially protruding projections 18 and 19 with which the nozzle halves are respectively supported on a radially external abutment 20 and 21 respectively. At their ends facing the abutment 20 and 21 respectively, the projections 18 and 19 have a respective inclined surface 22 and 23 which together with the abutment 20 and 21, respectively, forms a stop for an open position of the two nozzle halves 16 and 17. When being in contact with each other, the two nozzle halves 16 and 17 are supported on the abutment 20 and 21 via edges 24 and 25 of the inclined surfaces 22 and 23. The two nozzle havles 16 and 17 are pivotable about said edges to a limited degree.

When viewed in the feed direction T, the two nozzle halves 16 and 17 are radially compressed behind the projections 18 and 19 by helical compression springs 26 and 27 which are also supported on the abutment 20 and 21 respectively. The helical springs 26 and 27 simultaneously form a stop for the projections 18 and 19 and thus prevent a displacement of the nozzle halves 16 and 17 in the feed direction T.

The sleeve 6 forming the feed passage proper is provided in a tubular body 29 which is longitudinally displacable in a housing 28 in the feed direction T. With an end face 30 facing into the feed direction T the tubular body 29 is adjacent to the ends 31, 32 of the nozzle halves 16 and 17 facing the feed passage 3.

An annular piston 33 which together with the tubular body 29 can be reciprocated in an annular cylinder chamber 34 of the housing 28 is mounted on the outer circumference of the tubular body 29. At the side of the annular piston 33 facing away from the nozzle 4 the cylinder chamber 34 is connected to a compressed air source 38 through an axial bore 38 in the tubular body 29, an outer annular groove 36 and a compressed air pipe 37.

The outside of the tubular body 29 on which the annular groove 9 for the feed gas flow is also formed is sealed by means of sealing rings 39 relative to the housing 28. Likewise, the annular piston 33 also comprises a sealing ring 39.

The compressed air source 38 and the compressed air source 11 are connected to a control 40 by means of which the introduction of compressed air into the compressed air pipe 10 and 37 respectively can be controlled.

As can be seen from FIGS. 2 and 3 in a particularly clear way, the portion of the outlet port 14 of the insertion nozzle 4 has provided therein a radial bore 41 in which a pressure sensor 42 is arranged. The pressure sensor 42 is connected through a signal line 43 to a control means 44 which comprises an output 45 for connecting the motor of a feed roller (not shown) of a card. Such pressure sensing means are known. For instance, the signal line may also consist of a compressed air transfer line, the sensor being then arranged in the control means. Fiber residues, and the like can from time to time be removed from the radial bore 41 with the aid of the compressed air transfer means by the infeed of compressed air.

Figure 4:
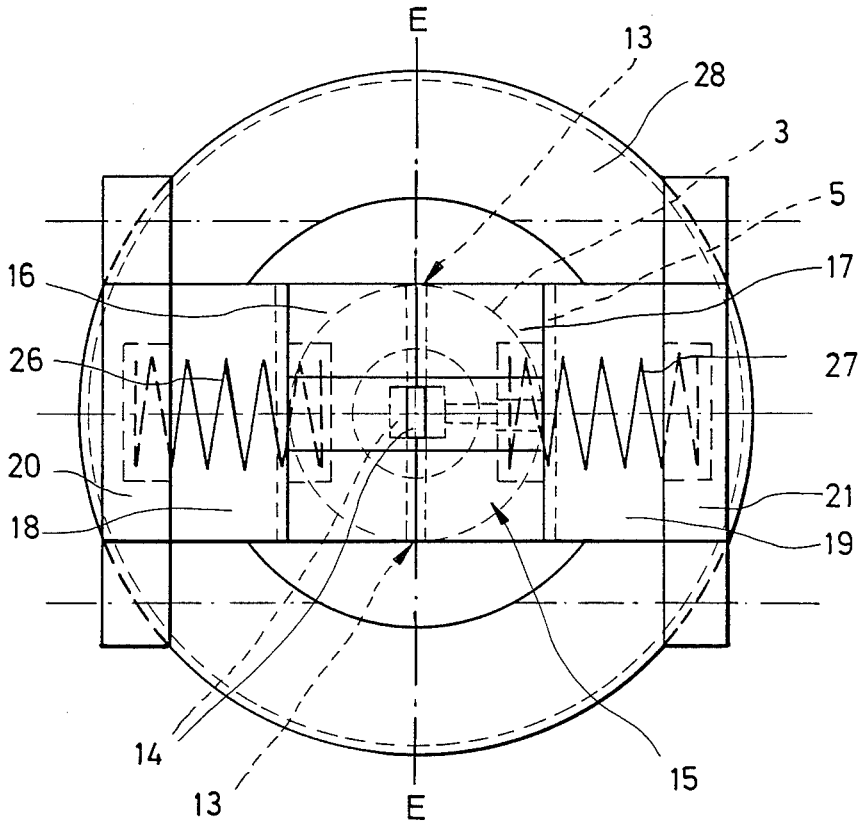
FIG. 4 is a view of the apparatus in the direction of arrows IV—IV.

As can clearly be seen from FIG. 4, the outlet port 14 has a rectangular cross-section. The main axis of symmetry of the rectangle is here located in the division plane E—E of the insertion nozzle.

The operation of the apparatus of the invention will now be explained in detail.

Prior to the introduction of a textile fiber sliver, the apparatus is in the state shown in FIG. 2 and, in continuous line, in FIG. 4. When the fiber sliver is to be introduced, the compressed air pipes 10 and 37 are acted upon with compressed air through the control 40 and the two compressed air sources 11 and 38. The compressed air fed into the compressed air pipe 10 passes through the annular groove 9 and the radial bore 8 into the gas chamber 7 and flows from there in the direction of the arrow through the spiral grooves 12 into the nozzle passage 5. A gas flow is thereby also generated in the feed passage 3 in the feed direction T.

The compressed air fed into the compressed air pipe 37 passes through the annular groove 36 and the axial bore 35 formed in the tubular body 29 into the cylinder chamber 34, i.e. at the side facing away from the insertion nozzle 4, whereby the annular piston 33 is displaced together with the tubular body 29 in the direction of the insertion nozzle 4. As can be seen in FIG. 3, this displacement has the effect that the two nozzle halves 16 and 17 open in a beaklike way by pivoting about the edges 24 and 25 of the projections 18 and 19 against the action of the two helical compression springs 26 and 27. The pivotal movement is only stopped when the two inclined surfaces 22 and 23 of the projections 18 and 19 are in contact with the abutments 20 and 21 respectively. The compressed air supply from the compressed air source 11 for generating the feed gas flow is maintained in this phase.

In the position shown in FIG. 3, the apparatus is ready for the introduction phase. When the two nozzle halves are pivoted apart, a longitudinal slot 13 through which the feed gas can escape laterally is respectively formed in the division plane E—E at both sides of the nozzle passage 5. At the same time, the cross section of the outlet port 14 is enlarged by the pivotal movement. As can be seen from the broken line in FIG. 4, the cross section of the outlet port is now almost square.

A fiber sliver is drawn in during this phase. At the introduction end of the feed passage the fiber sliver is gripped by the feed gas flow and blown through the nozzle passage 4 and gripped by the pair of feed rollers 2. As soon as the feed of the fiber sliver through this pair of feed rollers 2 is ensured, the compressed air source 38 is cut off by means of the control 40 and the air is released from the compressed air pipe 37. The cylinder chamber 34 is thus in communication with the ambient air. The helical compression springs 26 and 27 now effect a backward pivotal movement of the two nozzle halves 16 and 17, the tubular body 29 being slid back in a direction opposite to the feed direction T. The longitudinal slots 13 are closed and the outlet port 14 assumes the rectangular cross-sectional configuration shown in FIG. 4 in continuous line. When the two nozzle halves 16 and 17 are closed, the fiber sliver is compressed in a direction transverse to the division plane E—E. Likewise, the compressed air source 11 can now be cut off by means of the control 40.

During operation of the apparatus the fiber sliver is now compressed in the nozzle passage 5 and, in particular, in the outlet port 14 thereof, with the entrained air accumulating in the nozzle passage 5. The pressure build-up produced thereby is measured by the pressure sensor 42 and supplied to the control means 44 via the signal line 43. The pressure measured correlates with the thickness of the fiber sliver and can therefore be used for controlling the upstream card. The output 45 to which drives of the card can be connected in the known way is provided on the control means 44 for this purpose.

Although in the embodiment which is here described two separate compressed air pipes 10 and 37 are respectively provided for generating the feed gas flow and for opening and closing the nozzle halves respectively, it is also possible to providde only one compressed air pipe.

Finally, it may be of advantage to eccentrically arranged the outlet port of the nozzle passage relative to the central longitudinal axis thereof, but only to such an extent that the imaginary longitudinal axis still extends through the outlet area.

I claim:

1. An apparatus for compressing and automatically introducing a textile fiber sliver into a roller feed nip comprising:

a feed passage;

a flow generator for generating a gas flow in said feed passage;

an insertion nozzle extending from said feed passage and including a nozzle passage aligned with said feed passage and tapered in the flow direction to an outlet portion and to a lateral opening in the outlet portion for permitting said gas flow to escape from said nozzle passage; and a control for closing said lateral opening, said control keeping said lateral opening open during introduction of said fiber sliver and closing said opening during subsequent feed.

2. An apparatus according to claim 1 comprising a pressure sensor disposed in said outlet portion of said nozzle passage.

3. An apparatus according to claim 1, wherein said lateral opening is formed as a longitudinal slot extending from an outlet port of said nozzle passage in a longitudinal direction thereof within a plane substantially perpendicular to a plane of said feed nip.

4. An apparatus according to claim 1, wherein said feed passage includes a longitudinal axis and wherein, in a plane in which the longitudinal axis of said feed passage is substantially located, said insertion nozzle is divided into two nozzle halves which for forming longitudinal slots are constructed such that they can be moved apart and fixed at least in the nozzle portion, said longitudinal slots being closable by bringing said nozzle halves into contact with each other.

5. An apparatus according to claim 4, wherein said nozzle halves are pivotably supported at their ends facing said feed passage.

6. An apparatus according to claim 4, comprising resilient elastic elements wherein said nozzle halves can be pressed against each other by said resilient elastic elements substantially radially acting thereon in said outlet portion so as to close said longitudinal slots.

7. An apparatus according to claim 6, wherein said nozzle halves each include a respective end facing said feed passage, each respective end comprising a projection protruding radially outwards and supported on an outer abutment, each respective nozzle half being pivotable about each abutment against the action of said resilient elastic elements.

8. An apparatus for compressing and automatically introducing a textile fiber sliver into a roller feed nip comprising:

a tubular body including a feed passage;

a flow generator for generating a gas flow in said feed passage;

an insertion nozzle extending from said feed passage and including a nozzle passage aligned with said feed passage and tapered in the flow direction to an outlet portion and to a lateral opening in the outlet portion for permitting said gas flow to escape from said nozzle passage;

a control for closing said lateral opening, said control keeping said lateral opening open during introduction of said fiber sliver and closing said opening during subsequent feed; and wherein said tubular body is displacable in a housing in the longitudinal direction thereof relative to said nozzle.

9. An apparatus according to claim 8, wherein said tubular body includes an annular piston on the outside thereof, displacably arranged together with said tubular body in an annular cylinder chamber of said housing.

10. An apparatus according to claim 9, wherein said cylinder chamber is adapted to be connected to a compressed air source through air ducts.

11. An apparatus according to claim 4, wherein said nozzle halves form an outlet port of said nozzle passage between said nozzle halves, and wherein said outlet port includes a rectangular or polygonal cross-section.

12. An apparatus for compressing and automatically introducing a textile fiber sliver into a roller feed nip comprising:

a feed passage;

a flow generator for generating a gas flow in said feed passage;

an insertion nozzle extending from said feed passage and including a nozzle passage having an outlet portion, said nozzle passage aligned with said feed passage and tapered in the flow direction; and a pressure sensor disposed in said outlet portion of said nozzle passage.

13. An apparatus according to claim 1, wherein said feed passage includes a longitudinal axis, and wherein the outlet port of said nozzle passage in eccentriclaly arranged with respect to said longitudinal axis.

* * * * *